US005730426A

United States Patent [19]

Tu

[11] Patent Number: 5,730,426

[45] Date of Patent: Mar. 24, 1998

[54] WIRE MESH FENCE STRUCTURE

[76] Inventor: Yu-Pin Tu, No.101, Wen-Hua S Rd., Pu-Tzu City, Chia-I Hsien, Taiwan

[21] Appl. No.: 728,173

[22] Filed: Oct. 9, 1996

[51] Int. Cl.[6] ..... E04H 17/10

[52] U.S. Cl. ..... 256/54; 256/47; 256/32

[58] Field of Search ..... 256/32, 47, 48, 256/59, 65, 24, 68, 69, 21, 22, 54, 55

[56] References Cited

U.S. PATENT DOCUMENTS

| | | | |
|---|---|---|---|
| 183,601 | 10/1876 | Stover | 256/65 X |
| 194,724 | 8/1877 | Reed et al. | 256/65 X |
| 2,723,107 | 11/1955 | Parker | 256/24 |
| 2,826,394 | 3/1958 | Pinson | 256/65 X |
| 4,098,493 | 7/1978 | Logan | 256/47 X |
| 4,180,247 | 12/1979 | Pfarr, Jr. | 256/54 |
| 5,277,408 | 1/1994 | Parker | 256/59 X |
| 5,542,649 | 8/1996 | Allegaert et al. | 256/47 X |

FOREIGN PATENT DOCUMENTS

| | | | |
|---|---|---|---|
| 2150608 | 7/1985 | United Kingdom | 256/47 |

*Primary Examiner*—Harry C. Kim
*Attorney, Agent, or Firm*—Bacon & Thomas

[57] ABSTRACT

A wire mesh fence is formed by securing a plurality of spaced posts in concrete, each post being provided with upper and lower oppositely directed reverse hooks and hooking seats for engaging and supporting a pair of angle beams having a plurality of oppositely directed hanging hooks for securing a wire mesh between the beams.

4 Claims, 5 Drawing Sheets

WIRE MESH FENCE STRUCTURE

BACKGROUND OF THE INVENTION

The present invention relates to a checker-like iron wire mesh fence structure which can be assembled without limitation of tolerance and can be quickly installed without requiring any special technique.

It is known that some leisure sites such as swimming pools, tennis courts, baseball fields, etc. are surrounded by walls or iron wire meshes in order to control the access to these sites and facilitate the management. Such iron wire meshes are manufactured and installed in two ways as follows: 1. assembling type; and 2. welding type. Several shortcomings exist in such ways as follows:

1. Assembling type: The supporting posts are fixed by concrete. The interval between the posts and the inclination of the posts cannot be accurately controlled. Therefore, it often takes place that after the concrete is solidified, two adjacent posts are respectively inclined leftward and rightward. This results in the upper transverse beam and the lower transverse beam between the fixed posts being unequal to each other. Accordingly, the iron wire meshes can not be quickly installed.

2. Welding type: The transverse beam is welded to the fixed posts and the iron wire meshes are point-welded on the transverse beam and the posts into intersected checker-like iron wire meshes. Although the working speed is faster than that of the assembling type, because the material of the iron wire mesh is damaged due to the welding operation, the welded portions are subject to rusting and breakage. Therefore, the useful life of the product is shortened.

SUMMARY OF THE INVENTION

It is therefore a primary object of the present invention to provide a checker-like iron wire mesh fence structure in which the supporting posts and the upper and lower transverse beams are assembled with each other by hooking seats to achieve the following advantages:

1. The upper and lower transverse beams are engaged with hooking seats, whereby when installed, a thread rod is directly passed through the hooking seats to quickly secure the upper and lower transverse beams on the supporting posts.

2. It is unnecessary to cut off the upper and lower transverse beams due to the separation of the supporting posts. Therefore, when installed, the transverse beams can be extensively adjoined without limitation and it is possible to mass-produce the transverse beams.

3. The hooking seat is made directly by punching and bending so that it is quite easy to manufacture the hooking seat which has light weight and can be used more conveniently.

4. The parts of the hooking seat can be easily replaced so that the working time for processing is reduced and it is possible to mass-produce the hooking seat at low cost.

5. The assembly of the iron wire mesh fence can be easily completed without requiring any special technique.

The present invention can be best understood through the following description and accompanying drawings, wherein:

DETAILED DESCRIPTION OF THE PREFERRED EMBODIMENTS

Figure 1:
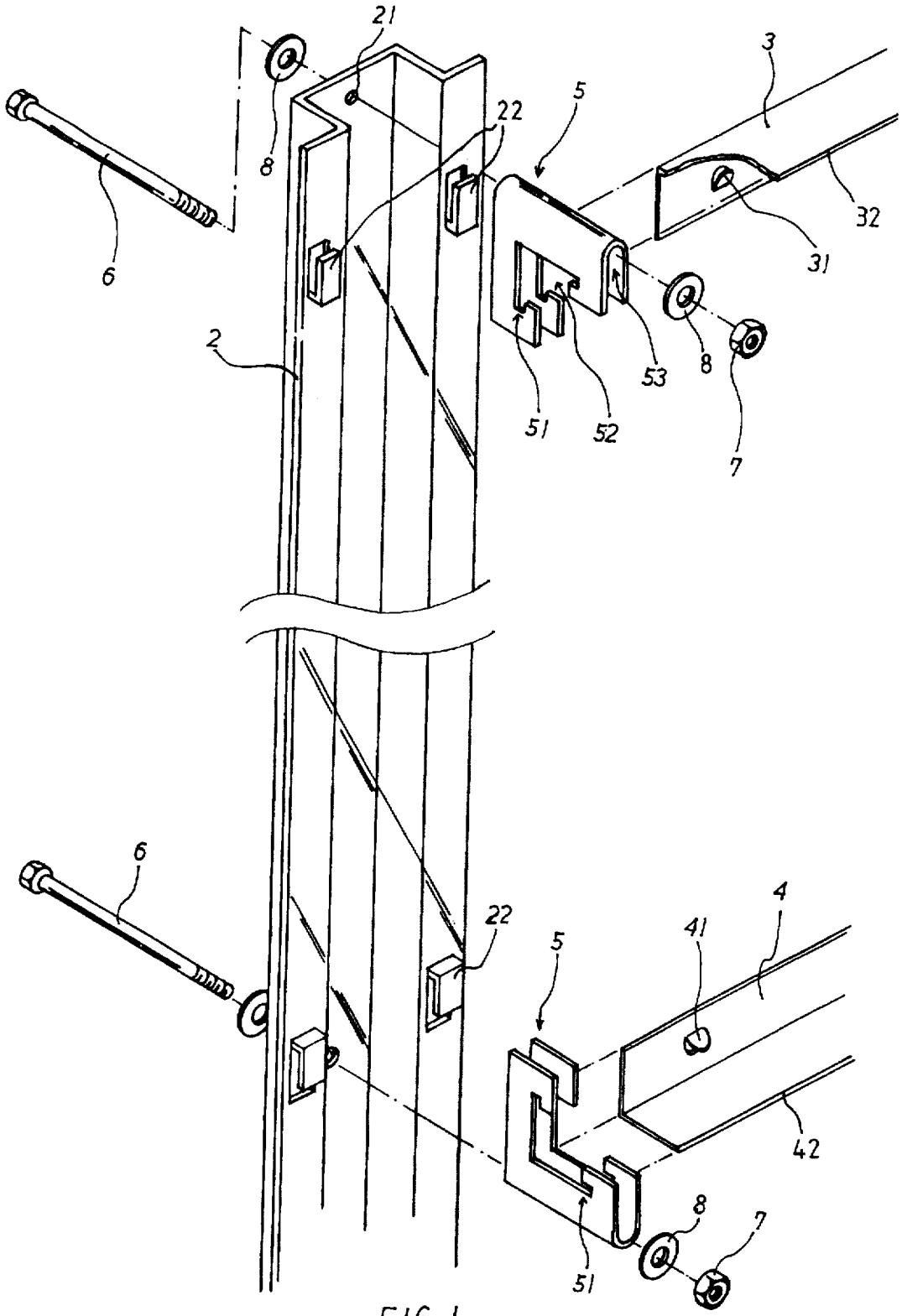
FIG. 1 is a perspective exploded view of the present invention.
Figure 2:
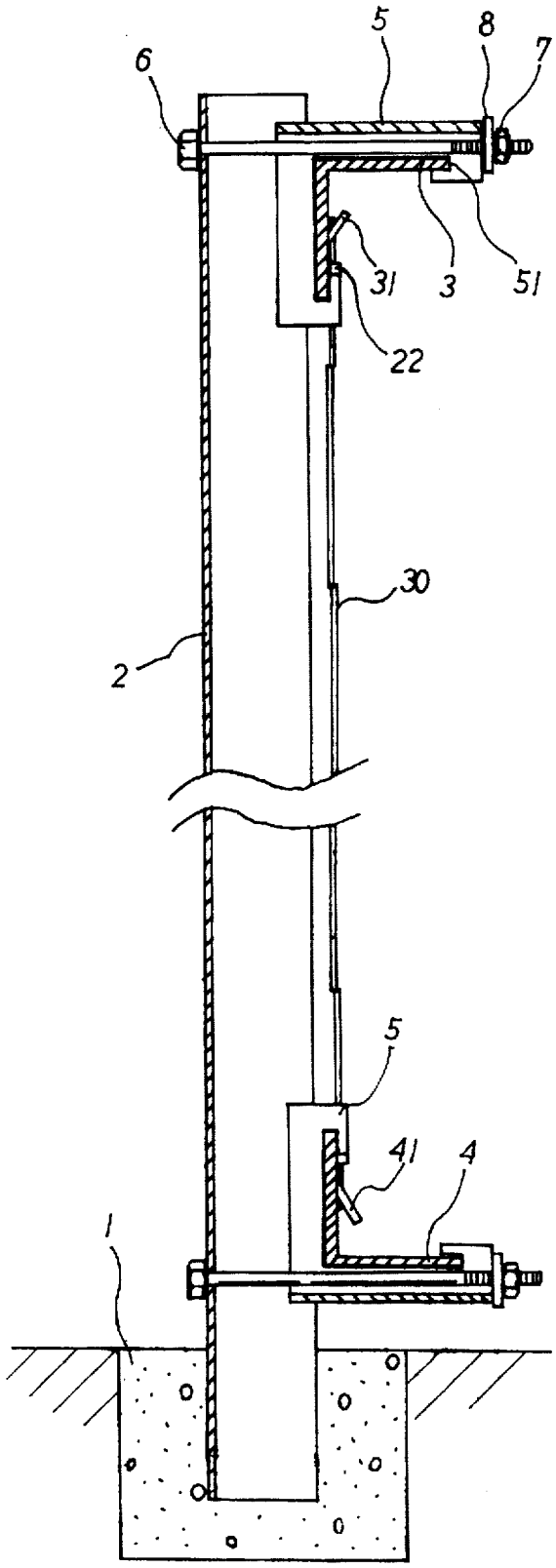
FIG. 2 is a side sectional view of the present invention.

Please refer to FIGS. 1 to 5. The checker-like iron wire mesh fence structure of the present invention consists of concrete 1, a plurality of supporting posts 2 set in concrete 1, an upper transverse angle beam 3, a lower transverse angle beam 4, an iron wire mesh 30, a plurality of hooking seats 5, a plurality of threaded rods 6, a plurality of nuts 7 and a plurality of washers 8.

The supporting post 2 has a U-shaped cross-section. Two lateral wall faces of the upper and lower ends of the supporting post 2 are punched to form oppositely directed upper and lower reverse hooks 22.

The upper and lower transverse angle beams 3, 4 have oppositely oriented angle legs punched to form multiple equally spaced and oppositely directed hanging hooks 31, 41 on the same side, whereby the upper and lower sides of the iron wire mesh can be hooked on the hanging hooks 31, 41.

The hooking seat 5 is made from a steel sheet by punching the same into a T-shaped member, two sides of which are equally bent toward each other to form the hooking seat 5 with a double L-shaped cross-section having an engagement opening in the form of a notch 52. The equal sides of the hooking seat 5 are parallel to adjoined with each other by a bight section 53.

Figure 3:
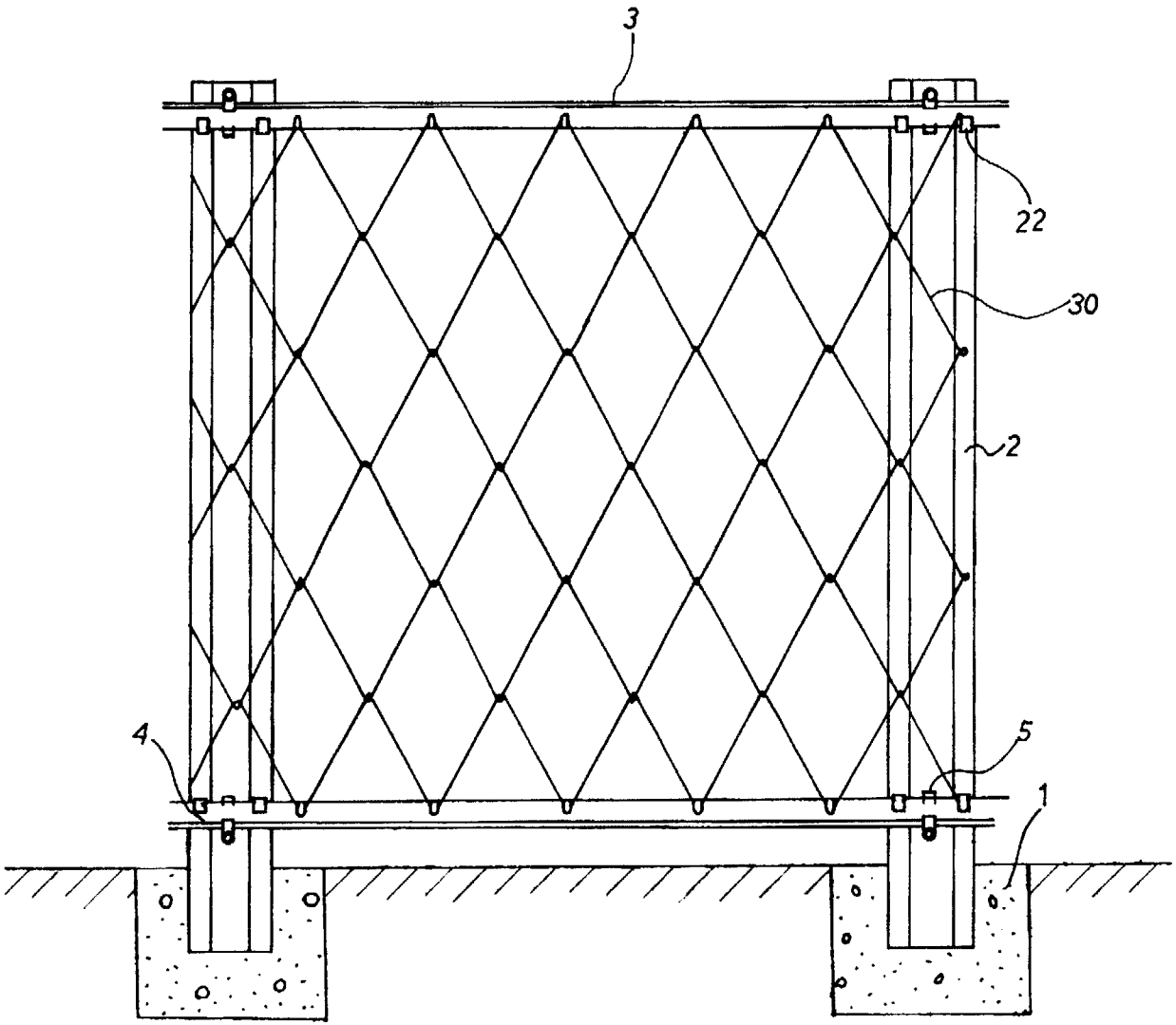
FIG. 3 is a front view of the present invention.

According to the above arrangement, the supporting posts 2 are fixed by the concrete 1 at equal intervals. The upper and lower transverse beams 3, 4 are respectively disposed in the notches 52 of the hooking seats 5. The threaded rod 6 is passed through the thread hole 21 of the supporting post 2 and the bight section 53 of the hooking seat 5. Then the washer 8 is fitted around the threaded rod 6 and the nut 6 is fastened on the threaded rod 6 to retain the upper transverse beam 3 in the reverse hooks 22 and secured on the supporting posts 2. The lower transverse beam 4 is similarly secured on the supporting posts 2 by means of the reversely directed hooking seat 5 and the threaded rod 6 and nut 7. Then the iron wire mesh 30 is hung on the hanging hooks 31, 41 of the upper and lower transverse beams 3, 4 to form the checker-like iron wire mesh as shown in FIG. 3.

Figure 4:
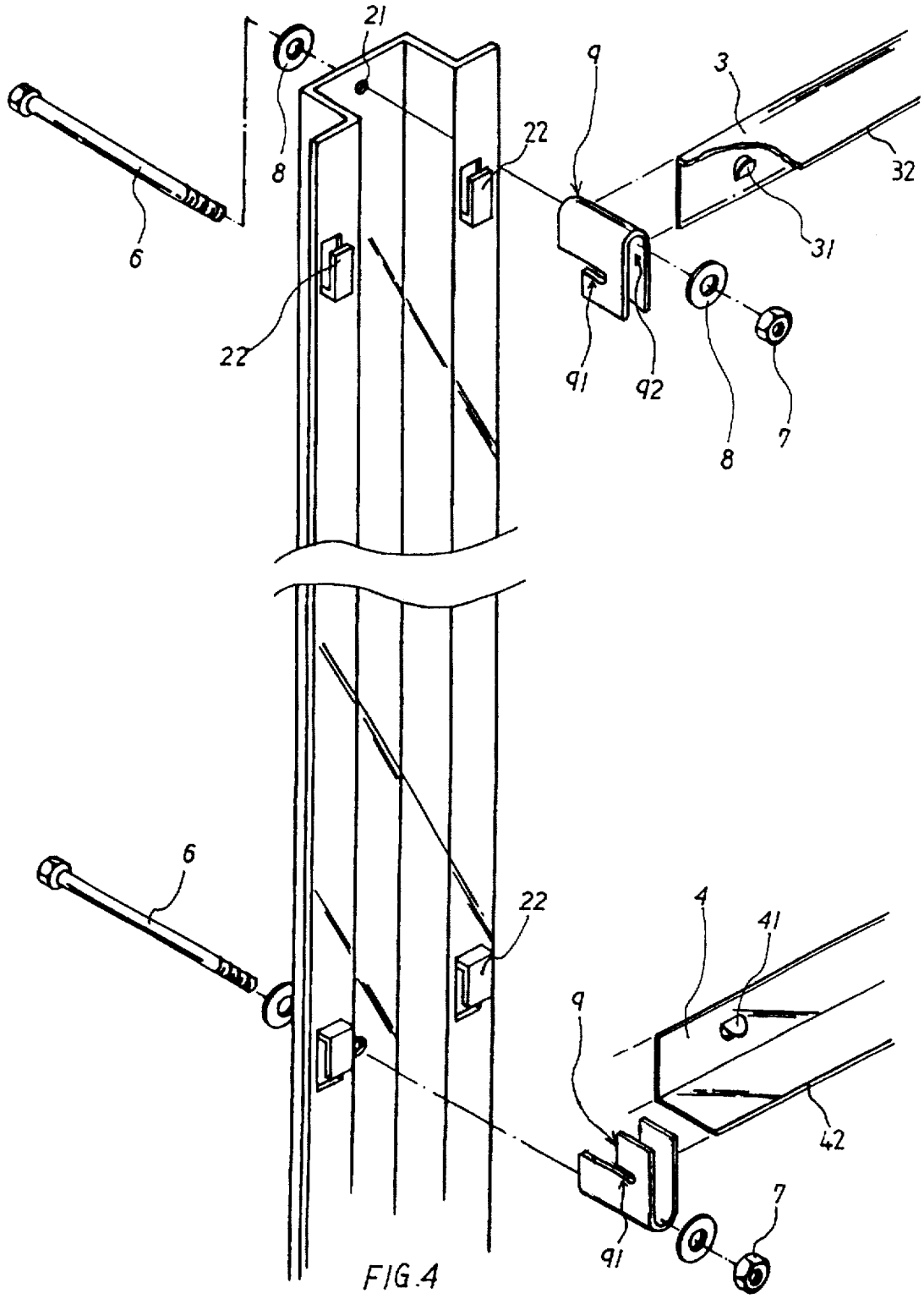
FIG. 4 is a perspective exploded view of another embodiment of the present invention.
Figure 5:
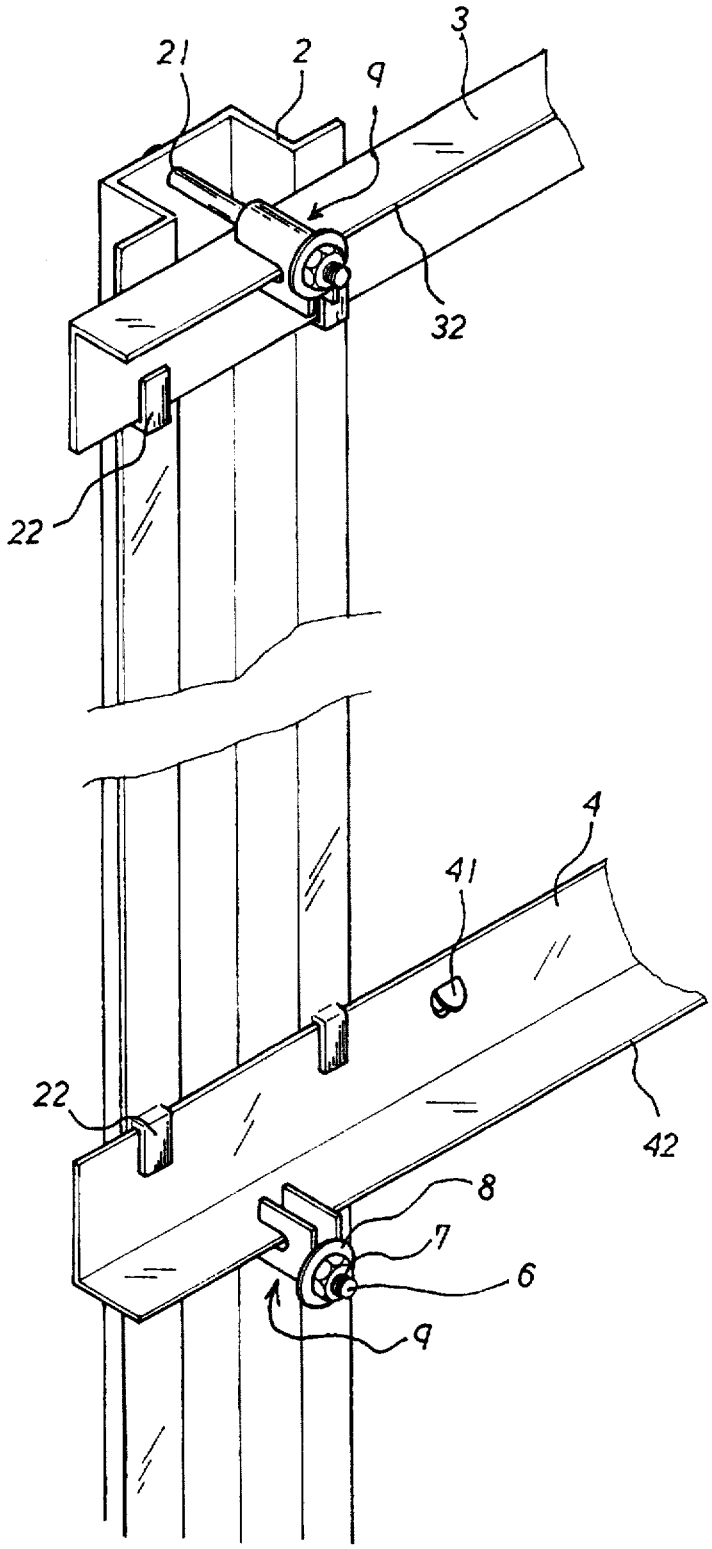
FIG. 5 is a perspective assembled view of the embodiment according to FIG. 4.

FIG. 4 shows another embodiment of Q hooking seat 9 which is punched into a substantially T-shaped member and oppositely bent into a hook-like member having an arrangement opening in the form of an insertion slot 91 for hanging the upper and lower transverse beams 3, 4 thereon. In addition, a bight section 92 of the hooking seat 9 defines a space for the thread rod 6 to pass therethrough.

After the supporting posts 2 are fixed, the upper and lower transverse beams 3, 4 are respectively directly placed into the reverse hooks 22 of the supporting posts 2. Then the insertion slots 91 of the hooking seats 9 are placed on the horizontal sections 32, 42 of the upper and lower transverse beams 3, 4. Then the iron wire mesh 30 is hung on the hanging hooks 31, 41 thereof to complete the assembly of the checker-like iron wire mesh structure.

The above embodiments are only examples of the present invention and the scope of the present invention should not be limited to the examples. Any modifications or variations derived from the examples should fall within the scope of the present invention.

What is claimed is:

1. A wire mesh fence structure comprising:

a) a plurality of spaced supporting posts secured in concrete, each post having a U-shaped cross-sectional configuration and including a pair of lateral wall faces provided with a plurality of oppositely directed upper and lower reverse hooks formed therein;

b) a plurality of hooking seats, fastening means securing one hooking seat adjacent the upper reverse hooks and one hooking seat adjacent the lower reverse hooks of each post, each hooking seat being of an L-shaped configuration and having an engagement opening formed therein;

c) a pair of angle beams extending between the posts, one angle beam being engaged within the upper reverse hooks and the engagement opening of their adjacent hooking seat and the other angle beam being engaged within the lower reverse hooks and the engagement opening of their adjacent hooking seat, and the angle beams being provided with a plurality of oppositely directed hanging hooks formed therein; and d) a wire mesh extending between the angle beams and secured to the hanging hooks of the beams.

2. The fence structure of claim 1 wherein:

a) each hooking seat is formed from a bent steel sheet having a T-shaped configuration and includes a pair of parallel L-shaped sections jointed by a bight section; and b) the fastening means includes a plurality of threaded fasteners extending through the posts and the bight section of each hooking seat.

3. The fence structure of claim 1 wherein the engagement opening is in the form of a notch.

4. The fence structure of claim 1 wherein the engagement opening is in the form of a slot.

* * * * *